US005709298A

United States Patent [19]

Harris

[11] Patent Number: 5,709,298

[45] Date of Patent: Jan. 20, 1998

[54] BASKET-STYLE CARRIER WITH NON-COLLAPSING END PANELS

[75] Inventor: Randall L. Harris, Powder Springs, Ga.

[73] Assignee: Riverwood International Corporation, Atlanta, Ga.

[21] Appl. No.: 687,236

[22] Filed: Jul. 25, 1996

[51] Int. Cl.[6] ..... B65D 71/52

[52] U.S. Cl. ..... 206/198; 206/162

[58] Field of Search ..... 206/162, 170, 206/171–173, 176, 178, 181–191, 193, 198

[56] References Cited

U.S. PATENT DOCUMENTS

| | | | |
|---|---|---|---|
| 3,709,400 | 1/1973 | Arneson | 206/187 |
| 3,917,061 | 11/1975 | Stout | 206/191 |
| 4,047,610 | 9/1977 | Stout et al. | 206/198 |
| 4,205,748 | 6/1980 | Wilson | 206/191 |
| 4,308,950 | 1/1982 | Wood | 206/189 |
| 5,031,760 | 7/1991 | Stout | 206/188 |
| 5,540,325 | 7/1996 | Harrelson | 206/193 |
| 5,547,074 | 8/1996 | Plaxico et al. | 206/193 |
| 5,579,904 | 12/1996 | Holley et al. | 206/162 |
| 5,590,762 | 1/1997 | Harrelson | 206/162 |

*Primary Examiner*—Jimmy G. Foster

[57] ABSTRACT

A basket-style carrier. The end panels are formed of overlapping end panel sections, the outer section of which is foldably connected to an upper portion of a central handle panel and the inner section of which is foldably connected to a lower portion of the handle panel. This results in an end panel formation which does not tend to collapse after a collapsed carrier is erected and also makes the carrier more rigid by tying in the full extent of the handle panel to the end panels.

12 Claims, 2 Drawing Sheets

BASKET-STYLE CARRIER WITH NON-COLLAPSING END PANELS

FIELD OF THE INVENTION

This invention relates to a basket-style carrier for packaging articles such as beverage bottles. More particularly, it relates to a basket-style carrier capable of maintaining an open square condition during loading of bottles or other articles.

BACKGROUND OF THE INVENTION

Basket-style carriers are commonly employed to package beverage bottles. They normally include a separate cell for each bottle, from which the bottles can be readily removed, and a center handle partition. The carriers are fabricated from a blank which is folded and glued into collapsed carrier form, after which the collapsed carrier is erected. In one design the bottom panel is integrally formed so that when the collapsed carrier is erected bottles may be inserted down onto the bottom panel through the open cells. In another design the bottom panel is formed by connecting bottom panel flaps together after the bottles have been inserted into the cells.

To insert bottles prior to forming the bottom panel the collapsed carrier must not only be opened to a square condition so as to permit entry of the bottles into the appropriate cells, but must be maintained in this condition until relative movement of the bottles into the carrier progresses to the point where the bottles themselves hold the carrier open. This is necessary because the end panels of a typical basket-style carrier include a vertical fold line aligned with the handle panel, which allows the end panels to be folded into collapsed condition. These end panel segments tend to fold back toward their original position after being initially opened, which misaligns the cells and bottles. Elements of the packaging machine can be designed to initially maintain the carrier in open condition until the bottles are inserted to the point where they are able to hold the carrier open. A preferable remedy, however, is to provide end panels which do not tend to collapse back to a prior folded condition.

One suggested design is to form the end panels from end panel flaps the upper portions of which are foldably connected to the handle panel or to a riser panel and the lower portions of which overlap each other. The overlapping portions of the end panel flaps do not permit the formed end panels to fold back to collapsed condition along the fold lines in their upper portions. Although such a structure prevents collapsing of the end panels the carrier is typical of other basket-style designs in that the handle is unsupported for a substantial distance above its connection to the end panels, making the carrier less than rigid. Also, like most basket-style carriers, a number of folding and gluing steps are required to form a collapsed basket carrier from a blank.

Another design is to form the end panels from end panel flaps which overlap for their entire height. The resulting carrier is still not of very rigid construction, however, and is formed from an elongated blank the layout of which is not as economically desirable as a more compact layout. Further, the layout provides for a two-ply handle, which is not structurally desirable for heavy loads.

It would be highly desirable to be able to maintain the erected carrier in open condition by means other than by packaging machine elements without complicating the carrier design or making it more expensive. It would also be desirable to be able to create a more rigid basket-style carrier which can be formed from a layout that does not require extensive fabrication steps.

BRIEF SUMMARY OF THE INVENTION

The invention is incorporated in a basket-style carrier in which the end panels are comprised of an outer end panel section overlapping and adhered to an inner end panel section. The outer end panel sections include an upper portion which extends upwardly beyond an associated inner end panel section and is foldably connected to the upper portion of the handle panel. The inner end panel sections are foldably connected to the lower portion of the handle panel. Because the outer and inner end panel sections are not foldably connected to each other the end panels will not collapse after erecting the carrier. This arrangement also produces a stronger, more rigid carrier since the upper portion of the handle panel is connected directly to the end panels, thereby preventing flexing movement of the handle. In a preferred arrangement the area of the handle panel incorporating a handle opening is of strong four-ply construction.

The design of the carrier does not interfere with the provision of cell-dividing partitions extending between the handle panel and the side panels. In addition, the design provides for an economical blank layout and simplifies formation of a collapsed carrier.

These and other features and aspects of the invention will be readily ascertained from the detailed description of the preferred embodiment described below.

DETAILED DESCRIPTION OF THE PREFERRED EMBODIMENT

Figure 1:
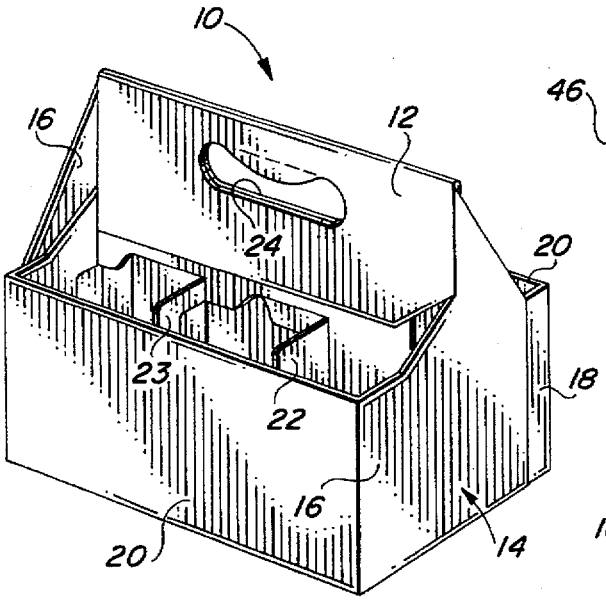
FIG. 1 is a pictorial view of a basket-style carrier incorporating the invention.
Figure 2:
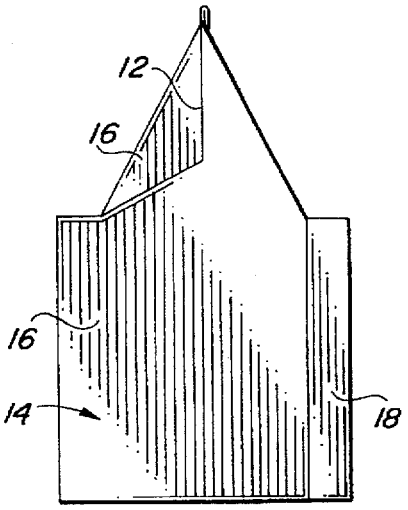
FIG. 2 is an end view of the carrier of FIG. 1.

Referring to FIGS. 1 and 2, the basket-style carrier 10 of the invention includes a central handle panel 12 connected to end panels 14. The end panels are comprised of outer end panel sections 16 which overlap inner end panel sections 18, both of which are connected to side panels 20. The bottom panel of the carrier is not visible in this view. Individual cells for receiving bottles or other articles are formed by partitions 22 and 23 which extend from the side panels 20 to the handle panel 12. The handle panel includes a handle opening 24.

Figure 3:
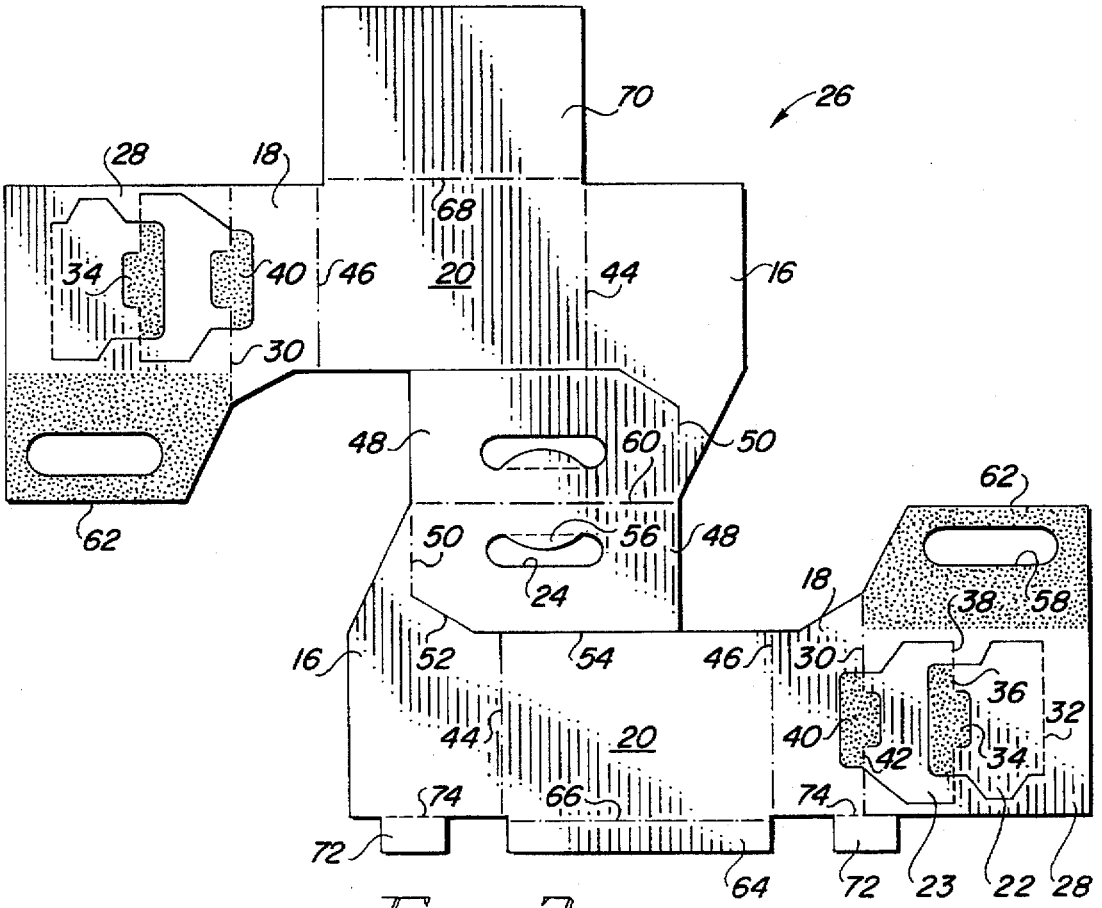
FIG. 3 is a plan view of a blank for fabricating the carrier of FIG. 1.

Referring to FIG. 3, wherein like reference numerals to those used in FIGS. 1 and 2 denote like elements, a blank 26 for forming the carrier is shown. The blank may be comprised of any suitably strong and flexible material but preferably is comprised of paperboard of the type conventionally used in the carrier industry. Basically, the blank is comprised of two half-blank portions, each being substantially identical but located so as to be in opposite reverse positions. Each half includes a handle panel section 28 connected to an end panel section 18 by discontinuous fold line 30. The cell-dividing partition 22 in each half of the blank is connected to the handle panel section 28 by continuous fold line 32 and to glue flap 34 by discontinuous fold line 36. The other cell-dividing partition 23 is connected to the handle panel section 28 by discontinuous fold line 38 and to glue flap 40 by discontinuous fold line 42. The fold line segments 36 are extensions of the fold line segments 38, while the fold line segments 42 are extensions of the fold line segments 30. The solid lines defining the partitions 22 and 23 represent slits which separate the partitions from the handle panel section 28. Similarly, the solid lines defining the glue flaps 34 represent slits which separate the glue flap 34 from portions of the partitions 22 and 23, and the solid lines defining the glue flaps 40 represent slits which separate the flue flap 40 from a portion of the partition 23 and a portion of the end panel section 18.

Connecting the side panel section 20 of each half of the blank to the end panel section 16 and the end panel section 18 are fold lines 44 and 46, respectively. The outer end panel section 16 is connected to an end edge of handle flap 48 by fold line 50, and the handle flap 48 is separated from the remaining adjacent edge of end panel section 16 by slit 52. Slit 54, which continues from the end of slit 52, separates the handle flap 48 from the side panel section 20. Handle opening 24 in the handle flap 48 is partially covered by tab 56, which is foldably connected to the handle flap 48. The handle panel section 28 is also provided with a handle opening 58 which is at least as large as, and preferably greater in size than, the handle opening 24. The handle flaps 48 of each half of the blank are connected by fold line 60, which if extended would be slightly spaced from the edges 62 of the handle panel sections 28.

One of the blank halves includes bottom panel glue flap 64 which is connected to the adjacent side panel section 20 by fold line 66, while the side panel section 20 of the other blank half is connected by fold line 68 to bottom panel flap 70. In addition, bottom panel forming tabs 72 are connected by fold lines 74 to the end panel section 16 of one of the blank halves and to the end panel section 18 adjacent the fold line 30 in the same blank half.

Figure 4:
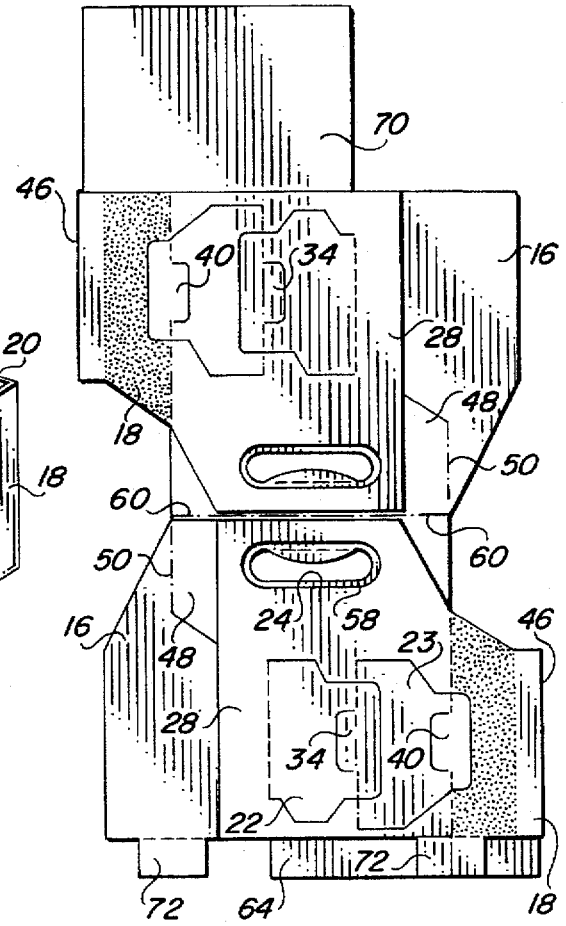
FIG. 4 is a plan view of the carrier blank after initial folding steps.

To form a carrier from the blank the portions of the handle panel sections 28 shown in stipple are coated with adhesive, as illustrated in FIG. 3, as well as the glue flaps 34 and 40. Each handle panel section 28 and the adjacent end panel section 18 are then pivoted as a unit about the fold lines 46 onto the outer handle panel sections 48 as illustrated in FIG. 4. This adheres the glue flaps 34 and 40 to the associated side panel section 20 and the upper portion of each handle panel section 28 to the associated handle flap 48. The handle openings 58 in the handle panel sections 28 overlie the associated handle openings 24 in the handle flaps 48. As shown in FIG. 4, the ends of the handle panels 28 fall somewhat short of the central fold line 60 to take the thickness of the handle panels into account for the next folding step.

The final step is to apply adhesive to the stippled areas of the end panel sections 18 shown in FIG. 4, then fold the blank segments about the central fold line 60. This adheres the upper portions of the handle panels 28 to each other and adheres the end panel sections 16 to their end panel sections 18, producing the collapsed carrier illustrated in FIG. 5. All the handle openings are aligned and the handle panel, formed from the handle panel sections 28 and the handle flaps 48, is of four-ply construction.

Figure 6:
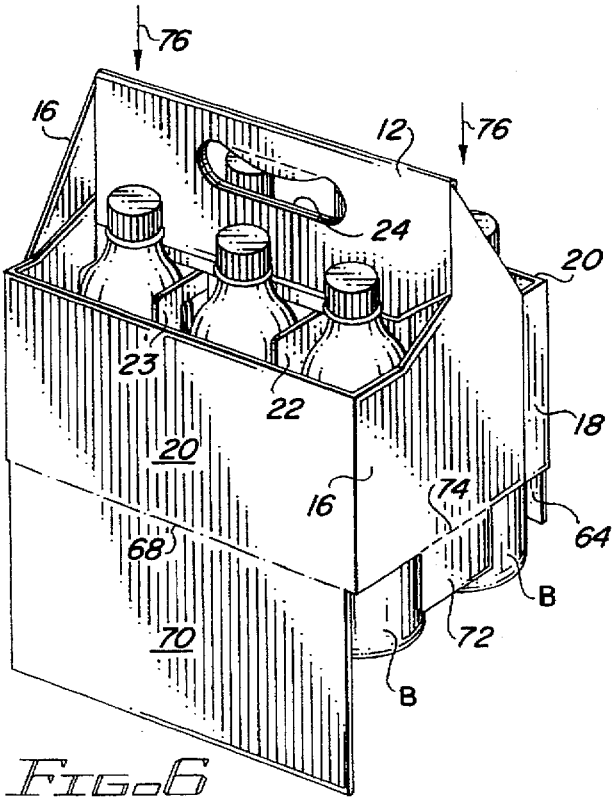
FIG. 6 is a pictorial view of an erected carrier in the process of being moved down over a group of bottles.
Figure 5:
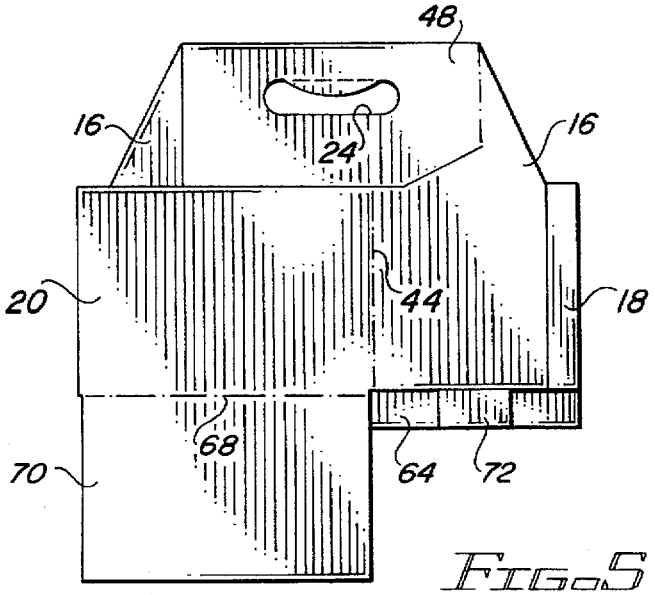
FIG. 5 is a plan view of a collapsed carrier resulting from a final folding step.

To form a loaded carrier from the collapsed carrier of FIG. 5, the collapsed carrier is squared up by applying inward pressure to the outer ends of the side panel sections, as is well known in the industry. The opened carrier is then aligned with a group of bottles to be packaged and lowered down over them, as indicated in FIG. 6 by the direction arrows 76. During this step the bottom panel flap 70, the bottom panel glue flap 64 and the bottom panel forming tabs 72 remain unfolded. After the carrier reaches its final position relative to the bottles, the forming tabs 72 are folded in about the fold lines 74 to bring them up against the bottoms of the bottles. The bottom panel flap 70 and glue flap 64 are then folded into overlapped position and adhered to each other and to the forming tabs to form the bottom panel of the carrier.

Because the end panel sections 16 overlap the end panel sections 18 and are not foldably connected to them, the end panels remain straight and do not collapse as the bottles are inserted into the cells. As a result there is no tendency for the carrier as a whole to fold back to its collapsed condition when the squaring-up force is withdrawn. The carrier thus remains in an open erected condition with the cells fully open to receive bottles during loading. Of course the carrier could be opened as described and bottles loaded into it by lowering them down into the cells instead of lowering the carrier down over the bottles. In either case the end panels remain flat and prevent collapsing of the carrier while the bottles are loaded.

The design of the carrier which connects the end panels to the handle panel throughout the height of the handle panel provides rigidity to the carrier since it prevents the handle from flexing transversely of the carrier length. Although the end panels could be designed so as to connect with the handle panel throughout only part of the handle height, the shorter the connection the less handle rigidity is maintained. It is preferred that the connection extend substantially to the top of the handle panel in order to maximize the strength and rigidity of the carrier.

In addition, the layout of the blank, in which identical halves are in opposite reversed positions and the end panel flaps are not foldably connected to each other, enables the carrier to be formed with only a minimum of folding and gluing steps. Also, while not essential to the invention, the provision of the bottom panel forming tabs assists in enabling the carrier to be more tightly formed about the bottles. As a result of the bottom panel flaps being adhered to the forming tabs 72, the side panels, by virtue of their integral connection to the bottom panel flaps, and the end panels, by virtue of their integral connection to the bottom panel forming tabs, are directly linked to the bottom panel. Thus the side panels, the end panels and the bottom panel are locked into place as a unit after the bottom panel flaps and the bottom panel forming flaps are moved into place, causing the bottles about which the bottom panel is formed to be tightly held in place. Obviously, the invention is not limited to the formation of a bottom panel from a major bottom panel flap and a bottom panel glue flap, but could be formed instead from two overlapping bottom panel flaps of substantially equal width.

It should now be apparent that the invention not only prevents collapsing of erected carriers prior to completion of the loading process, but at the same time strengthens and rigidifies the carrier. Although the invention has been described in connection with a carrier designed for holding bottles, it applies equally as well to carriers designed to hold other types of articles instead. It is contemplated that the invention need not necessarily be limited to all the specific details described in connection with the preferred embodiment, but that changes to certain features of the preferred embodiment which do not alter the overall basic function and concept of the invention may be made without departing from the spirit and scope of the invention defined in the appended claims.

What is claimed is:

1. A basket-style article carrier, comprising:

opposite side panels connected to a bottom panel;

a centrally located handle panel having an upper portion and a lower portion;

opposite end panels connected to the side panels, each end panel being comprised of an outer end panel section overlapping and being adhered to an inner end panel section;

each inner end panel section being connected to the lower portion of the handle panel by a fold line; and each outer end panel section having an upper portion extending upwardly beyond an associated inner end panel section, the upper portion of each outer end panel section being connected to the upper portion of the handle panel by a fold line.

2. A basket-style article carrier as defined in claim 1, wherein the fold lines connecting the inner end panel sections to the lower portion of the handle panel and the fold lines connecting the outer end panel sections to the upper portion of the handle panel are substantially aligned.

3. A basket-style article carrier as defined in claim 1, wherein the handle panel has an upper edge, the fold lines connecting the upper portion of the outer end panel sections to the upper portion of the handle panel extending substantially to the upper edge of the handle panel.

4. A basket-style article carrier as defined in claim 1, including at least one cell-defining partition extending transversely from each side panel to the handle panel.

5. A basket-style article carrier as defined in claim 1, wherein the upper portion of the handle panel includes a handle opening therein.

6. A basket-style article carrier as defined in claim 5, wherein the lower portion of the handle panel is of two-ply construction and the upper portion of the handle panel surrounding the handle opening is of four-ply construction.

7. A basket-style article carrier as defined in claim 1, wherein the bottom panel is comprised of two connected bottom panel flaps, each bottom panel flap being foldably connected to a side panel.

8. A blank for forming a basket-style carrier, comprising:

two half-blank portions;

each half-blank portion including a handle flap connected to the handle flap of the other half-blank portion by a fold line, said fold line being the only connection between the two half-blank portions, each handle flap having first and second opposite end edges extending substantially at right angles to said fold line, the first end edge of each handle flap being substantially aligned with the second end edge of the other handle flap;

an outer end panel section in each half-blank portion, each outer end panel section having an upper portion and a lower portion, the upper portion of each outer end panel section having an outer edge and an inner edge and the lower portion of each outer end panel section having an outer edge and an inner edge;

the inner edge of the upper portion of each outer end panel section being connected by a fold line to the first end edge of an associated handle flap;

the inner edge of the lower portion of each outer end panel section being connected by a fold line to a side panel section;

the side panel section of each half-blank portion being connected by a fold line to an inner end panel section; and the inner end panel section of each half-blank portion being connected by a fold line to a handle panel section;

the inner and outer end panel sections having dimensions such that when the blank is folded to form a carrier, the outer end panel section of each half-blank portion contacts and overlaps the inner end panel section of the other half-blank portion.

9. A carrier blank as defined in claim 8, wherein the fold line connecting the inner edge of the upper portion of each outer end panel section to the first end edge of an associated handle flap extends substantially to the fold line connecting the handle flaps of each half-blank portion.

10. A carrier blank as defined in claim 8, wherein at least one cell-dividing partition is foldably connected to each handle panel section.

11. A carrier blank as defined in claim 8, wherein each handle panel section includes a handle opening therein and each handle flap includes a handle opening therein, the handle openings being located so that all the handle openings are aligned in a carrier formed from the blank.

12. A carrier blank as defined in claim 8, wherein each side panel section is connected by a fold line to a bottom panel flap.

* * * * *